US005862698A

United States Patent [19]

Yogo

[11] Patent Number: 5,862,698

[45] Date of Patent: Jan. 26, 1999

[54] BENDING DEVICE

[75] Inventor: Teruaki Yogo, Nagoya, Japan

[73] Assignee: Kabushiki Kaisha Opton, Seto, Japan

[21] Appl. No.: 994,282

[22] Filed: Dec. 19, 1997

[51] Int. Cl.[6] ..... B21D 7/04

[52] U.S. Cl. ..... 72/173; 72/307

[58] Field of Search ..... 72/173, 172, 170, 72/166, 288, 307

[56] References Cited

U.S. PATENT DOCUMENTS

| | | | |
|---|---|---|---|
| 3,373,587 | 3/1968 | Shubin | 72/158 |
| 3,613,430 | 10/1971 | Crees | 72/388 |
| 3,986,381 | 10/1976 | Shubin | 72/217 |
| 4,000,636 | 1/1977 | Shubin | 72/173 |
| 4,404,833 | 9/1983 | Andersen | 72/388 |
| 4,747,293 | 5/1988 | Yagi | 72/294 |
| 4,825,678 | 5/1989 | Post | 72/307 |
| 5,239,850 | 8/1993 | Shimokata | 72/166 |

FOREIGN PATENT DOCUMENTS

| | | | |
|---|---|---|---|
| 1154824 | 6/1989 | Japan . | |
| 127919 | 4/1992 | Japan | 72/173 |

*Primary Examiner*—Daniel C. Crane
*Attorney, Agent, or Firm*—Davis and Bujold

[57] ABSTRACT

There is proposed is a bending device which has a simple structure, easily performs a control and provides a high degree of freedom in bending. The bending device is provided with a positioning jig 6 with a clearance hole 4 formed therein for passing a material 1 to a bending jig 34 for contacting an outer periphery of the material supplied from the positioning jig 6. A rotary body 18 is rotated by a rotating drive source 22 coaxially with the material passed through the clearance hole 4 in the positioning jig 6. The bending jig 34 is attached to a member 30 pivotably supported by the rotary body 18, and pivoted by a cylinder 38, to bend the material 1.

3 Claims, 1 Drawing Sheet

BENDING DEVICE

BACKGROUND OF THE INVENTION

The present invention relates to a bending device for bending a pipe, a round bar or other elongated materials.

A known bending device is, as proposed in a publication of Japanese patent application laid-open No. Hei 1-154824, provided with a fixed positioning jig with a clearance formed therein for passing a material, a bending jig with a clearance formed therein for passing the material supplied from the positioning jig, and a slide mechanism for moving the bending jig vertically and horizontally relative to a material supply direction, so that the material being supplied is bent by moving the bending jig. Further in the device, the bending jig is swingably supported vertically and horizontally in such a manner that the clearance in the bending jig is directed to a direction of a tangent line of the material to be bent. The device is also provided with two drive sources for swinging the bending jig vertically and horizontally.

In the prior-art device, however, the bending jig is moved vertically, i.e. perpendicularly to the material supply direction and horizontally, and swung vertically and horizontally, thereby complicating a mechanism. Further, multiple drive sources need to be controlled by a control device. Therefore, its control mechanism is also complicated. Additionally, the bent material easily interferes with the slide mechanism, and a degree of freedom in bending is disadvantageously restricted.

SUMMARY OF THE INVENTION

An object of the present invention is to provide a bending device which has a simple structure, easily performs a control and provides a high degree of freedom in bending.

To attain this and other objects, the invention provides a bending device for elongate bendable material is provided with a positioning jig with a clearance opening formed therein for passing a material longitudinally to a bending jig arranged is contact an outer periphery of the material for bending the material in accordance with the position of the bending jig, comprising a rotary body which is rotated by a rotatable drive source coaxially about with the material passed through the clearance in the positioning jig and the bending jig is attached to a member pivotally supported by the rotary body, and pivotable by a drive source to adjust the magnitude and degree of bending of the material.

Also, the drive source can be a trunion mounted cylinder mounted on the rotary body.

BRIEF DESCRIPTION OF THE DRAWINGS

The invention will now be described, by way of example, with reference is the accompanying drawing, in which.

DETAILED DESCRIPTION OF THE PREFERRED EMBODIMENT

Figure 1:
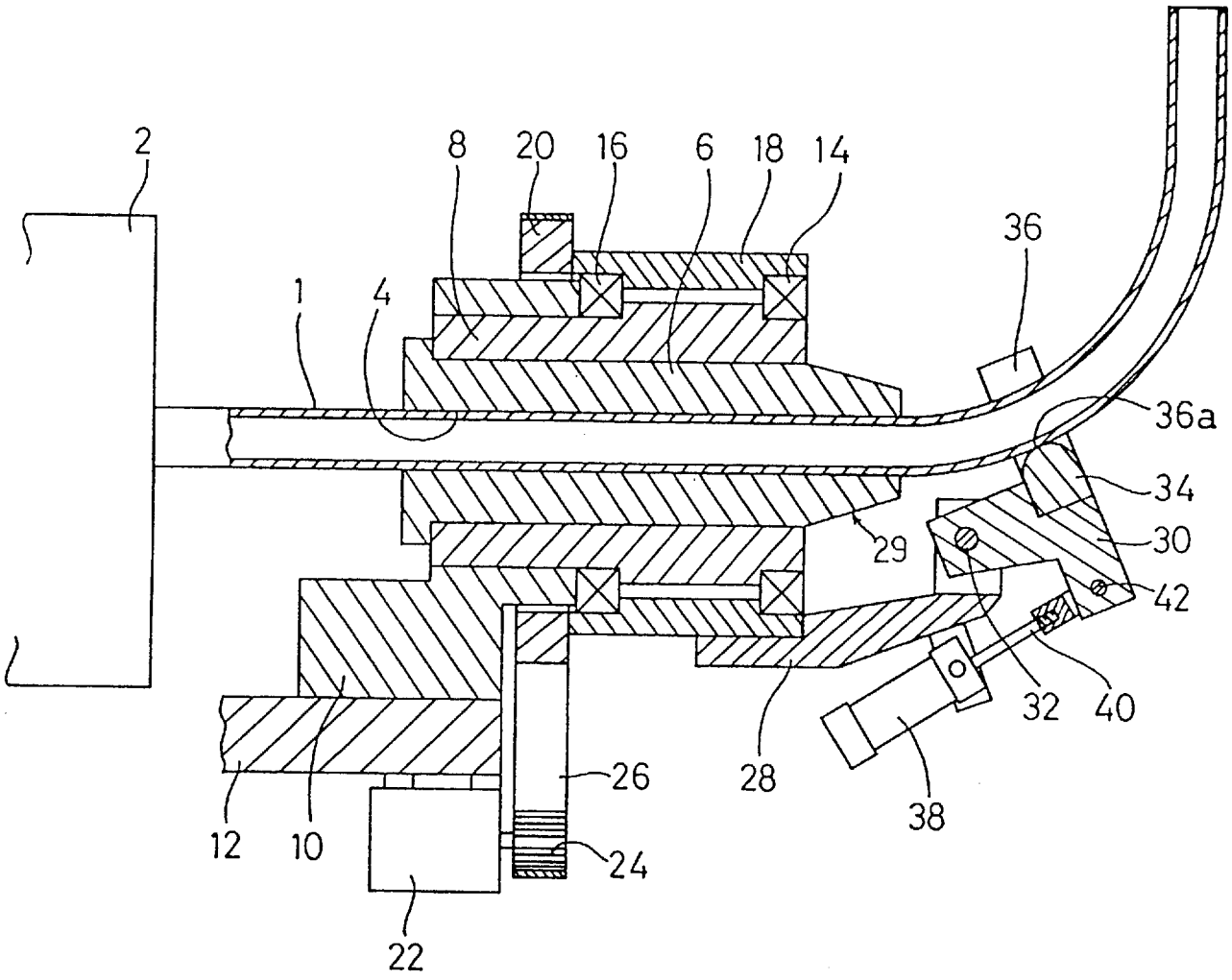
FIG. 1 is a sectional view of a bending device embodying the present invention.

As shown in FIG. 1, a pipe is used as an example. A bending device is provided with a supply mechanism 2 for supplying the material 1 in an axial direction, and a positioning jig 6 with a clearance 4 formed therein for passing the material 1 supplied from the supply mechanism 2.

The positioning jig 6 is extends through a support collar 8, and the support collar 8 is mounted to a body 12 by a mounting portion 10. On the support collar 8, a rotary body 18 is rotatably supported by a pair of bearings 14 and 16 coaxially with the material 1 passing through the clearance 4 in the positioning jig 6. A pulley 20 is attached to the rotary body 18, and a pulley 24 is attached to a motor 22 fixed to the body 12. A belt 26 drivingly joins the pulleys 20 and 24.

An arm member 28 is fixed to the rotary body 18 on an outlet side 29 of the positioning jig 6. On the arm member 28, a pressure applying member 30 is pivotably supported by a pin 32 which is orthogonal to the supply direction of the material 1. A bending jig 34 is attached to the member 30 and define a U-shaped groove 36.

The groove 36 is formed with sufficient width to accommodate material 1. When the member 30 is pivoted, a bottom 36*a* of the groove 36 contacts an outer periphery of the material 1. On the arm member 28, a pneumatic or hydraulic cylinder 38 is pivotally supported. A rod 40 of the cylinder 38 is connected via a pin 42 to the member 30. Other actuator known in the art of pressure application, instead of the trunnion-type cylinder, for example, a hydraulic motor, the like can be used.

An operation of the bending device according to the embodiment is now described.

First, the material 1 is supplied in the axial direction by the supply mechanism 2 and the material 1 passes through the clearance 4 in the jig 6 and then through the groove 36 in the bending jig 34. When the material 1 is not pressed by the bottom 36*a* of the groove 36 in contact with the outer periphery of the material 1, the material 1 passes straight through the groove 36.

At the time of bending, driving axial feeding of the material 1, the swinging drive source 38 is driven to pivot the member 30 around the pin 32. A pivot angle is associated with a bending radius of the material 1: when the swing angle is large, the bending radius is reduced; and when the swing angle is small, the bending radius is increased. By swinging the pressing member 30, the material 1 is pressed by the bending jig 34 via the bottom 36a in contact with the outer periphery of the material 1.

The material 1 supplied by the supply mechanism 2 in the axial direction is passed through the clearance 4 in the positioning jig 6, and then bent to a predetermined bending radius under a pressure exerted by the bending jig 34. When the bending is complete, the member 30 is pivoted by the source 38, and the bending jig 34 returns to its original position.

FIG. 1 shows that the material 1 is bent upward. When the bending direction is changed, for example, when the material 1 is transversely bent, the motor 22 is driven, thereby rotating the pulley 24. The rotation of the pulley 24 is transmitted via the belt 26 to the pulley 20, to rotate the rotary body 18 by 90 degrees.

As a result, together with the rotary body 18, the bending jig 34 is rotated around the material 1 by 90 degrees. Then, the bottom 36*a* contacts a side face of the outer periphery of the material 1. Subsequently, as aforementioned, by driving the swinging drive source 38, the bending member 30 is swung at an angle in accordance with the bending radius. Therefore, the material 1 supplied form the supply mechanism 2 is pressed in the transverse direction by the bending jig 34, and transversely bent.

Consequently, by operating the rotary body 18 and the member 30 with the motor 22 and the cylinder 38, the material 1 may be bent three-dimensionally with a simple structure. Since only the motor 22 and the cylinder 38 need to be controlled, an associated control mechanism is simple. Further, since attitudes of the rotary body 18 and the member

30 are controlled by the motor 22 and the cylinder 38, high-precision bending can be achieved.

Further, the bending device is not provided with a large slide mechanism having a slide table and the like, and a large space can be secured around the positioning jig 6. Therefore, the bent material 1 is prevented from interfering with the device, and a degree of freedom in bending is enhanced.

As aforementioned, in the bending device of the invention, the rotating and swinging drive sources operate the rotary body and the pressing member to bend the material three-dimensionally with a simple structure.

What is claimed is:

1. A bending device being supported by a body, the bending device comprising:

a mounting portion having an edge, the mounting portion being attached to the body;

a support collar being non-movably attached to the mounting portion such that a portion of the support collar extends beyond the edge of the mounting portion, the support collar being substantially cylindrical and having an axis along through which is disposed a through-bore;

a positioning jig, having a material input side and an outlet side, the positioning jig being disposed in the through-bore with the outlet side extending through the portion of the support collar extending beyond the edge of the mounting portion, the positioning jig having a clearance opening formed therein for passing a material longitudinally to a bending jig arranged to contact an outer periphery of the material, for bending the material in accordance with the position of the bending jig;

a rotary body being a collar-like, hollow cylinder, the rotary body being rotatably coupled to portion of the support collar extending beyond the edge of the mounting portion;

a rotary movement facilitation mechanism disposed circumferentially about the rotary body;

a controllable rotary drive unit being attached to one of the body and the mounting portion, the rotary drive unit having a power transfer mechanism engaged with the rotary movement facilitation mechanism such that the rotary drive unit can rotate the rotary body; and a bending portion, the bending portion comprising:

an arm member, extending away from the rotary body, having a first end attached to the rotary body and a second end remote from the rotary body;

a pressure applying member being pivotally attached to the second end of the arm member;

a bending jig attached to the pressure applying member; and a controllable hydraulic cylinder pivotally attached to the arm member, the hydraulic cylinder having a piston extending therefrom pivotally attached to the pressure applying member.

2. The bending device of claim 1, wherein the rotary movement facilitation mechanism is a pulley, the controllable rotary drive unit is a motor having a drive pulley attached to its shaft, and wherein the power transfer mechanism is a drive belt.

3. The bending device of claim 1, wherein the rotary movement facilitation mechanism is a sun gear, the controllable rotary drive unit is a motor, and wherein the power transfer mechanism is a pinion gear attached to the motor shaft, the teeth of the pinion gear being meshed with the teeth of the sun gear.

* * * * *